United States Patent [19]

Mahon

[11] Patent Number: 4,616,209

[45] Date of Patent: Oct. 7, 1986

[54] "KEEP WARM" CONTROL

[75] Inventor: Joseph J. Mahon, Libertyville, Ill.

[73] Assignee: Eaton Corporation, Cleveland, Ohio

[21] Appl. No.: 495,895

[22] Filed: May 18, 1983

[51] Int. Cl.[4] ..... G08B 1/00

[52] U.S. Cl. ..... 340/309.15; 340/309.5; 200/35 R; 200/38 R

[58] Field of Search ..... 340/309.15, 309.5, 309.3; 219/493, 10.55 B, 10.55 L; 74/568 T; 200/36, 37 R, 38 C, 53 BB, 38 R, 39 R, 35 R, 38 BA

[56] References Cited

U.S. PATENT DOCUMENTS

| | | | |
|---|---|---|---|
| 3,694,591 | 9/1972 | Bassett et al. | 200/35 R |
| 3,824,365 | 7/1974 | Tapper . | |
| 4,133,998 | 1/1979 | Otani | 200/38 C |
| 4,153,824 | 5/1979 | Blackmond | 200/38 BA |
| 4,206,337 | 6/1980 | Marquis | 200/38 BA |
| 4,467,664 | 8/1984 | Willigman et al. | 200/38 C |
| 4,523,062 | 6/1985 | Mahon | 200/35 R |

*Primary Examiner*—Ulysses Weldon
*Assistant Examiner*—Tyrone Queen
*Attorney, Agent, or Firm*—C. H. Grace; R. A. Johnston

[57] ABSTRACT

A single timing motor (26) drives a gear box (54) having an output shaft (56) for indexing a ratchet wheel (62) for turning a cam drum (68). One cam track (72) operates a line switch (22) for controlling the program interval "ON" time of the appliance. A second cam track (70) operates a second line switch (40) for controlling the timing motor. A toothless space (66) in the ratchet wheel stalls cam drum advance upon program interval time-out to maintain the timer switch (40) closed to keep the motor running. Output shaft 56 drives a sub-interval cam (80) which cycles a switch (48) for effecting intermittent appliance "ON" time for a minor portion of the sub-interval period to provide a "KEEP-WARM" mode of operation. An alarm bell (100) is sounded by a striker (98) actuated by the sub-interval cam. The operator manually advances the cam drum (68) for de-actuating the timer motor switch (40). A manual mode-selector switch (34) enables by-passing the sub-interval switch (48) to select either the "COOK" only mode of operation or "COOK" and "KEEP-WARM" modes.

10 Claims, 4 Drawing Figures

"KEEP WARM" CONTROL

BACKGROUND OF THE INVENTION

The present invention relates to program timing for electrically operated appliances and in particular relates to program timing for microwave cooking appliances.

Heretofore, control of the interval or duration of electrical energization of a microwave cooking device has been effected by employing a set of switch contacts opened and closed by rotation of a cam drum advanced by a mechanism driven from a sub-fractional horsepower timing motor. Typically in such applications, the cam drum is initially rotated manually by the appliance operator to a position representing the desired cooking interval and the manual rotation of the drum closes a set of contacts for starting the timing motor and a set of contacts for energizing the microwave magnetron.

In such an arrangement, the cam drum is thereafter rotated by the timing motor by the amount representing the selected cooking program interval or "time-out"; and, the cam drum is operable to open the contacts for de-energizing the magnetron and cutting off power to the timing motor. Thus, heretofore, upon termination of the cooking program interval, the appliance was automatically turned off by the programmer timer.

However, where a more sophisticated or complex cooking program has been desired, as for example intermitent or variable magnetron operation during the cooking interval, it has been found necessary to employ a plurality of timer motors for activating separate timing programmers alternatively, electronic timing means have abeen employed which included solid state switching relay devices to handle the power required for energization of the magnetron. Such plural motor programmers or electronic timer programmers have been costly to manufacture. Thus, it has been desired to find a simple low-cost technique for expanding the capability of the programmer timer and yet employ only a single timing motor to drive the cam drum for actuating plurality of circuit function control switches.

In particular it has been desirable to find a way or means of providing partial or intermitent energization of a microwave cooking magnetron upon completion of the cooking cycle for purposes of maintaining the cooked food in a warm state. Prior techniques of providing a post-cooking "KEEP-WARM" mode of operation have required additional timing mechanisms or expensive solid state electronic control circuitry. This it has long been desired to provide such a "KEEP-WARM" function for a microwave cooking oven without incurring the cost of replacing the simple single timing motor actuated programmer timer.

SUMMARY OF THE INVENTION

The present invention relates to program timing for electrical appliances and in particular microwave ovens for cooking. The present invention provides a simple low cost electromechanical programmer timer powered by a single sub-fractional horsepower synchronous timing motor driving a cam drum for actuating a plurality of circuit function control switches. The timing motor is connected through a gear reduction train to drive an oscillating advance pawl operative to successively index a ratchet wheel for rotating a cam drum. The drum has a plurality of cam tracks each operable to actuate and de-actuate a set of switch contacts in the appropriate sequence and for a desired interval.

The ratchet wheel is provided with a toothless space immediately prior to the "time-out" or shut-off position. The advance pawl, upon contacting the toothless space, is rendered inoperative to advance the ratchet wheel. The magnetron is de-energized prior to the advance pawl reaching the toothless space; however, the timing motor continues to run thereby providing advance pawl oscillation. A sub-interval cam is provided on the drive shaft providing the pawl oscillation and a set of switch contacts responsive to the sub-interval cam causes the magnetron to be cycled at the rate of rotation of the sub-interval cam. The sub-interval cam rotation provides for continued cyclic energization of the magnetron for only a minor fraction of the sub-interval cycle thereby providing a "KEEP-WARM" mode of operation.

An optional alarm bell is provided which is also cycled by the sub-interval cam to provide a reminder that the appliance is operating in the "KEEP-WARM" mode.

When it is desired to terminate the "KEEP-WARM" mode of operation, it is necessary for the appliance operator to manually advance the cam drum to actuate the switch contacts for cutting off power to the timing motor.

DETAILED DESCRIPTION

Figure 1:
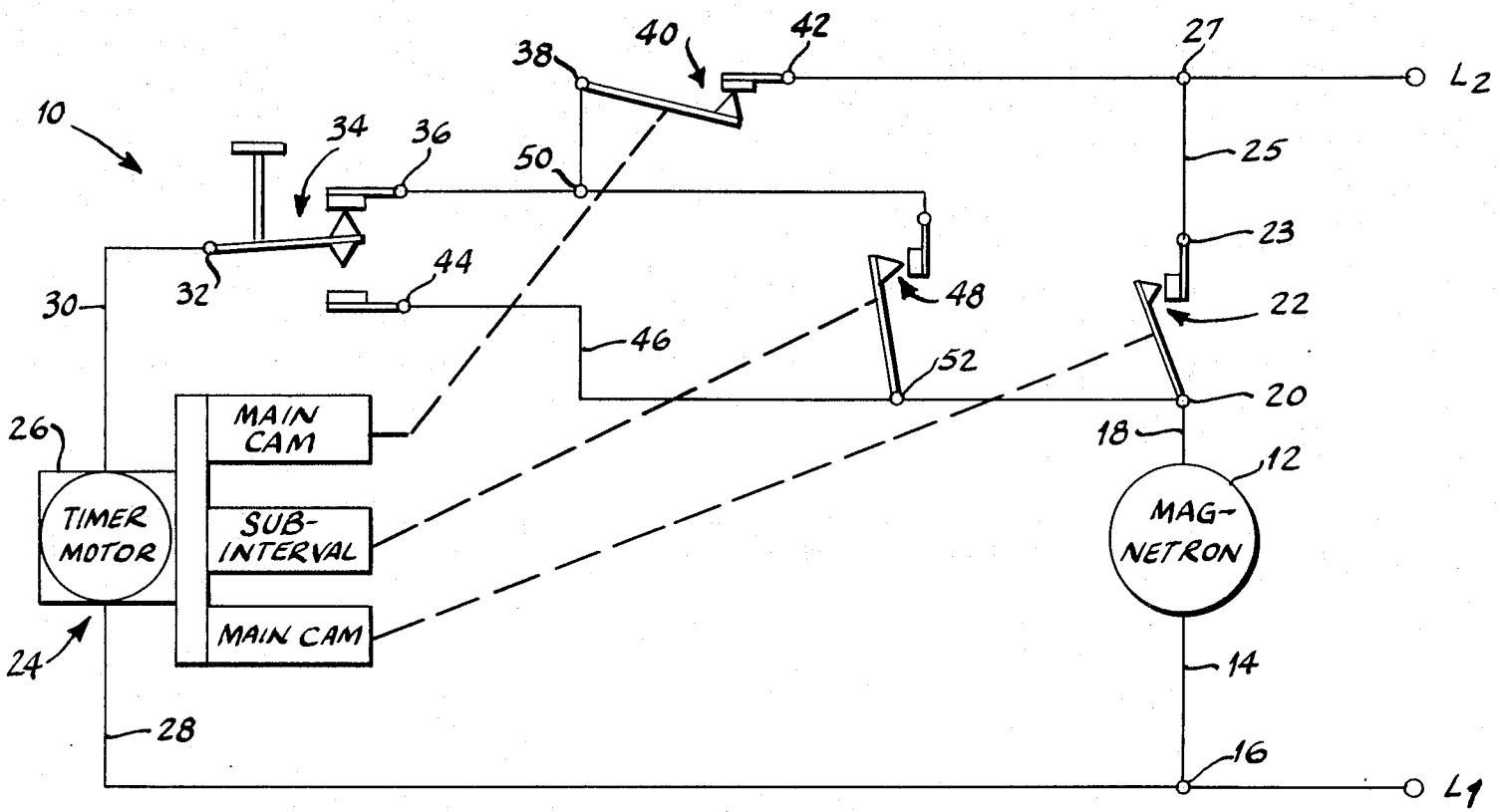
FIG. 1 is an electrical schematic of a control system for a microwave cooking appliance.

With reference to FIG. 1 a control system indicated generally at 10 is illustrated which the invention is embodied in a microwave cooking oven having an electrically energized magnetron 12 operative to emit radio frequency radiation for cooking. One power lead 14 from the magnetron is connected through junction 16 to one side $L_1$ of a power line and the other power lead 18 of the magnetron is connected to junction 20 which comprises the one terminal of a magnetron power switch indicated generally at 22. The remaining terminal 3 of switch 23; connected via level 25 to junction 27 on power line $L_2$.

A programmer timer indicated generally at 24 has a timing motor 26, preferably of the sub fractional horsepower synchronous type, with one power lead 28 thereof connected to power line junction 16. The remaining power lead 30 of the timing motor is connected to junction 32 which comprises the common terminal of a singel pole double throw MODE SELECTOR switch indicated generally at 34 which is manually operated. Switch 34 has one stationary contact thereof connected via junction 36 to connecting terminal 38 of a timer power switch indicated generally at 40. Switch 40 has one stationery contact thereof connected via terminal 42 to the remaining side $L_2$ of the power line.

The remaining stationary contact of switch 34 is connected via terminal 44 and lead 46 to junction 20.

A switch indicated generally at 48 is connected across the power line $L_2$ and lead 46 by connecting junctions 50, 52. Switch 48 is thus in parallel with switch 22. With reference to FIG. 1, it will be understood that closure of either switch 22 or 48 will energize magnetron 12 irrespective of the position of switch 40; whereas, switch 48 can energize magnetron 12 only in the event switch 40 is closed.

Figure 2:
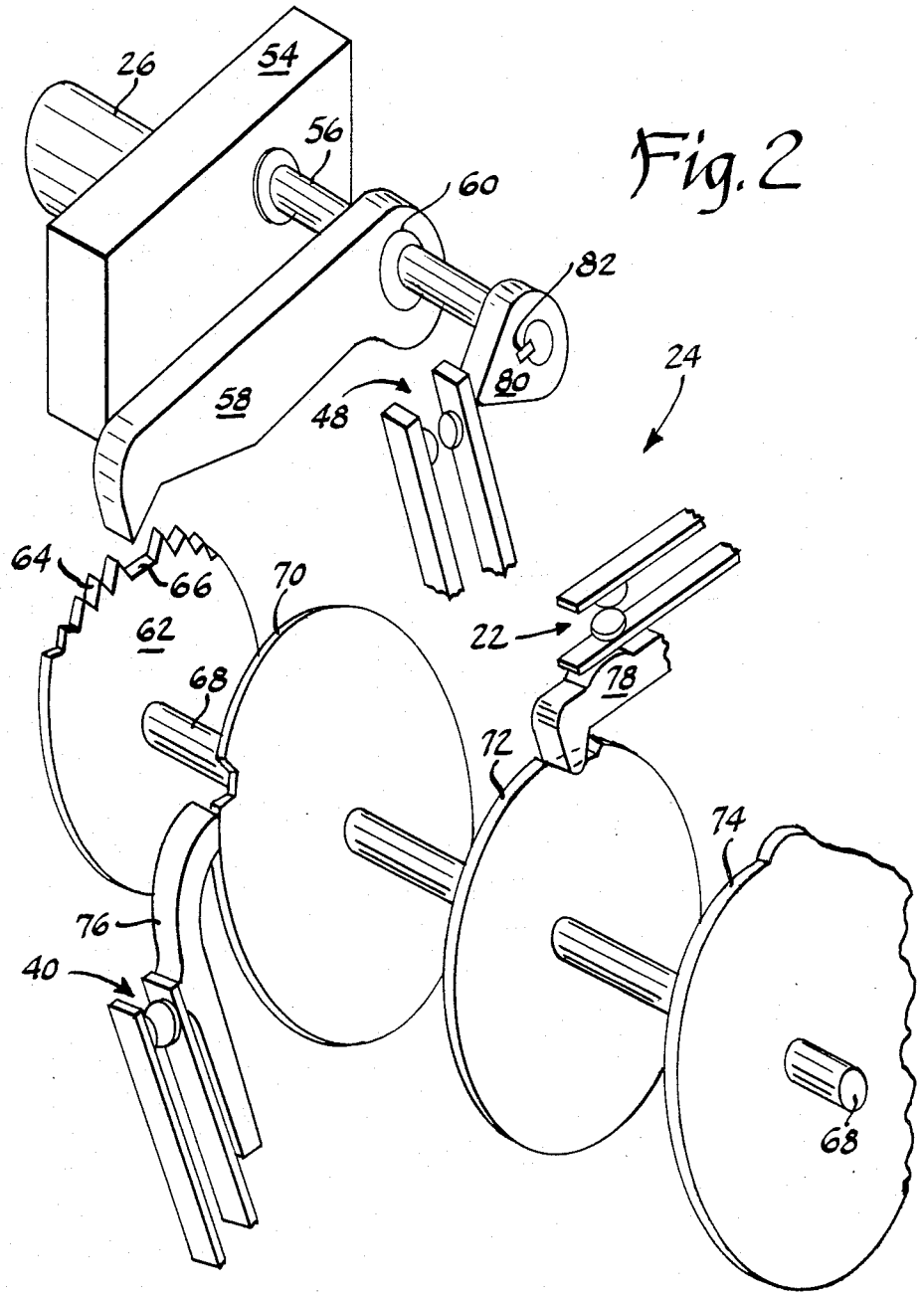
FIG. 2 is an exploded pictorial in perspective of the programmer timer mechanism of the present invention.

Referring now to FIGS. 1 and 2, the timer motor 26 is connected to a gear box 54 having an output shaft 56 rotatable at a suitable rate, which in the presently preferred practice invention is four revolutions per minute. An advance pawl 58 is connected to shaft 56 by means of having an end therof apertured and received over an eccentric 60 on the shaft such that pawl 58 is oscillated thereby upon rotation of the shaft 56.

An advance ratchet 62 is provided having a plurality of ratchet teeth 64 provided about the periphery thereof for engagement by the free end of advance pawl 58 which is suitably chisel-pointed. The wheel 62 has a toothless space 66 provided about the periphery thereof, functioning as a dwell means, for permitting the oscillating pawl 58 to engage the ratchet wheel 62 in lost-motion engagement for preventing indexing of the ratchet wheel.

Ratchet wheel 62 is connected to a cam shaft or drum 68 in a rotationally driving connection such that advancement of the ratchet wheel 62 by pawl 58 indexes the drum 58.

Drum 58 has a plurality of spaced peripheral cam tracks 70, 72, 74 preferably spaced axially therealong for rotation with shaft 68. Cam track 70 has a cam follower 76 in contact therewith and switch 22 is disposed for actuation by the cam follower 76.

Cam track 72 similarly has a cam follower 78 in contact therewith for effecting actuation of switch 40 which is appropriately disposed adjacent follower 78.

The eccentric shaft 56 has a sub-interval cam lobe 80 provided thereon and secured by any suitable expedient, as for example key 82, for rotation with the shaft 56. Cam lobe 80 has switch 48 disposed in contact therewith for cyclic actuation and de-actuation upon rotation of cam lobe 80.

Referring now to FIG. 2, the cam tracks 70, 72, 74 are so disposed and configured in the presently preferred arrangement that, upon completion of the program interval or "time-out", cam follower 78 moves to effect opening of switch 22 for cutting off power to the magnetron as the advance pawl contacts the dwell means 66 and ratchet wheel 62. The consequent lost motion movement of the pawl 58 in dwell means 66 permits ratchet wheel 62 to remain stationary. With ratchet wheel 62 stationary in the position shown in FIG. 2, cam follower 76 maintains switch 40 in the closed position thereby continuing power to timer motor 26 for continuing rotation of shaft 56.

Continued rotation of shaft 56 causes cam 82 to effect cycling of switch 48 at the sub-interval frequency; and, in the presently preferred practice, maintains switch 48 open for a minor fraction of the sub-interval period of cam 82. This minor fraction sub-interval duty cycle of switch 48 in turn causes the magnetron to be pulsed "ON" for periods of time and at spaced intervals sufficient only to provide a "KEEP WARM" functional mode of operation and insufficient "ON" time to effect further cooking.

When it is desired to discontinue the "KEEP WARM" mode of operation, the ratchet wheel 62 and cam drum are manually advanced a small amount by the appliance operator to cause cam track 70 to effect movement of cam follower 76 for opening switch 40. Switch 40 cuts off power to the timer motor and thereby stopping the cycling of switch 48.

Figure 4:
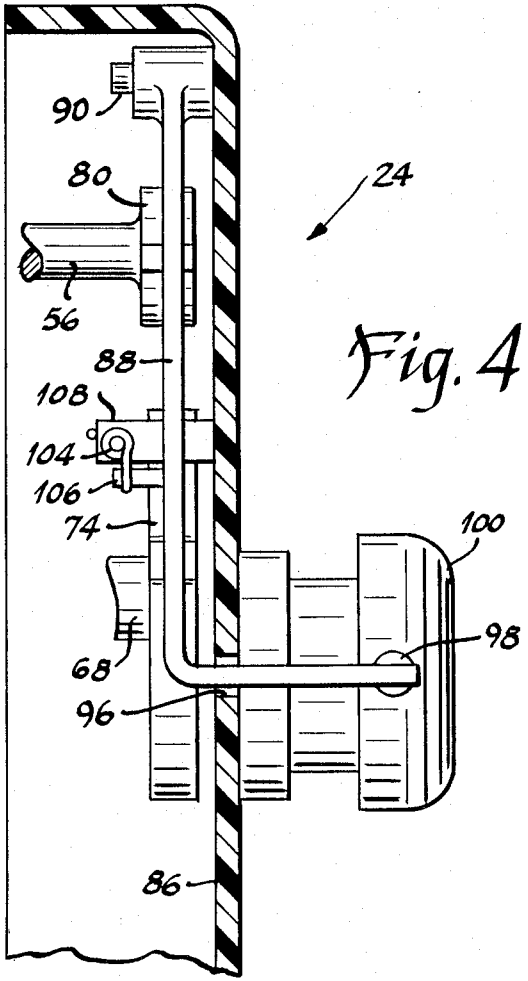
FIG. 4 is an enlarged section view taken along section indicating lines 4—4 of FIG. 3.
Figure 3:
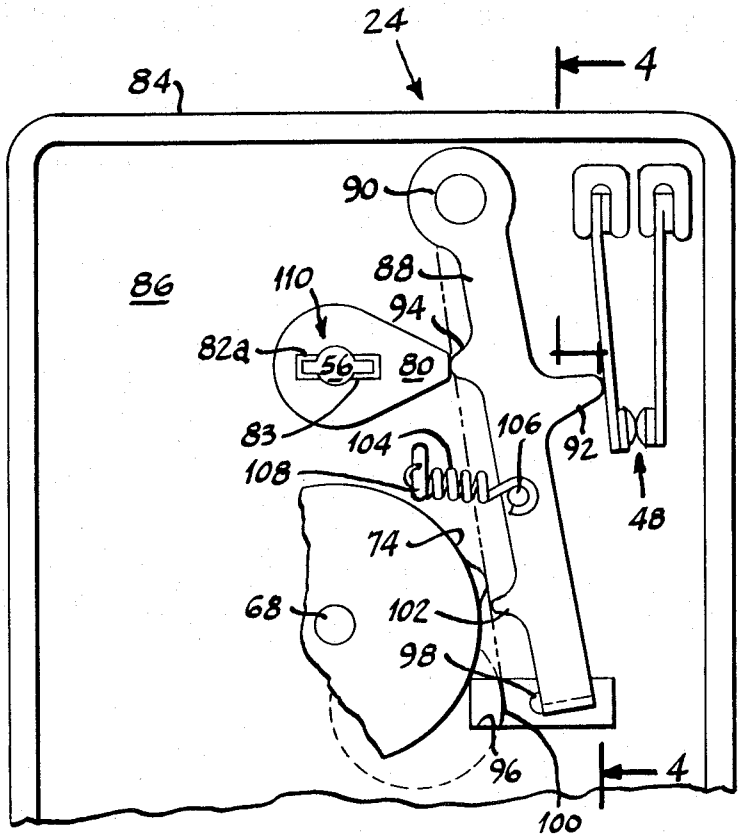
FIG. 3 is a plan view of a portion of one embodiment of the programmer timer of the present invention.

Referring now to FIGS. 3 and 4, the feature of the invention is illustrated wherein, during the "KEEP WARM" mode of operation, an alarm bell is continuously cycled indicating that the appliance is operating in "KEEP WARM" mode. In the embodiment of FIGS. 3 and 4, the programmer timer 24 is mounted in a housing or body 84 having a wall or mounting deck 86 apertured to receive drive shaft 56 therethrough. Sub-interval cam 80 is disposed adjacent the upper surface of the deck or the left hand side as shown in FIG. 4.

In the embodiment of FIGS. 3 and 4 a moveable arm 88 is pivotally mounted at one end thereof about pin 90 which extends from the left hand or upper surface of the deck 86 and has an actuator portion 92 preferably formed integrally therewith, for contacting the blade of switch 48. Arm 88 has a cam follower 94 formed thereon for contact with the lobe on sub-interval cam 80. The free end of arm 88 is formed at right angles to the upper or left hand surface of the deck 86 and extends through an apperture 96 formed in the deck. The end of arm 88 which extends through aperture 96 has attached thereto a suitable striker or clapper 98 disposed for impact against an alarm bell 100 mounted on the lower or right hand side of the deck 86.

Arm 88 also has cam follower 94 disposed intermediate the ends thereof. A second cam follower 102 is disposed intermediate the free end of arm 88 and cam follower 94. Shaft 68 and cam track 74 (see FIG. 2) are disposed adjacent the upper or left hand face of deck 86 such that cam follower 102 on arm 88 is in a position for contacting cam track 74.

With reference to FIG. 3, sub-interval cam 80 is shown as contacting cam follower 94 in solid outline in the position of maximum lift by cam 80. Switch actuating portion 92 has closed switch 48 and striker 98 is lifted from contacting bell 100. In the position of maximum lift shown in FIG. 3, arm 88 also prevents cam follower 102 on arm 88 from contacting cam track 74.

A bias spring 104 has one end thereof anchored to a lug 106 provided on arm 88 and the other end anchored to a stationary lug 108 extending from the upper left hand face of deck 86. Spring 108 thus biases arm 88 leftward in FIG. 3 or in a direction to urge the cam follower 94 into contact with sub-interval cam 80 and cam follower 102 into contact with cam track 74.

In the presently preferred practice of the invention, the drive shaft 56 has a lost motion connection indicated generally at 110 wherein shaft 56 has a key 82A provided thereon and preferably in the form of a double headed key. Cam lobe 80 has a slot 83 provided therein and configured to conform generally to the shape of the double headed key 82A. Slot 83 is configured so as to permit a desired amount of rotational movement of shaft 56 before causing rotational movement of cam load 83. This minor amount of rotational lost motion is operative to cause a snap-action of the cam 80 when follower 94 is in contact with the descending ramp of the cam lobe. This sudden or rapid rotational movement of the cam load 80 upon follower 94 encountering the descending ramp thereof, permits a sudden drop of striker 98 onto the bell 100 providing the cam lobe on track 74 is not engaging cam follower 102 to prevent fall or leftward movement of the arm 88. The position of arm 88 in the bell striking position is shown in dashed outline in FIG. 3.

In operation, upon the advance pawl 58 encountering the dwell means 66 on rachet wheel 62, rotation of the cam drum shaft 68 is terminated and cam track 70 maintaines switch 40 closed. The timer motor 26 continues to run and to cycle cam load 80 for raising and lowering arm 88 thereby cycling magnetron switch 48 and the striker against bell 100. In the position shown in FIG. 3, cam track 74 does not prevent the striker 98 from contacting bell 100. When the appliance operator desires to terminate the "KEEP WARM" operational mode, cam drum shaft 68 is manually advanced by the operator causing cam follower 76 to drop into the notch on cam track 70 for opening switch 40 to stop the timing motor.

With reference to FIG. 3, when the advanced pawl 58 rotates cam drum shaft 68 such that cam track 72 causes cam follower 78 to open the magnetron switch 22 for the end of the "COOK" cycle, cam track 74 is operative to cause the lobe thereon to engage cam follower 102 on arm 88 thereby lifting the arm and permitting the lobe to pass by follower 102 and permitting the striker 98 to contact bell 102 to thereby signal the end of the "COOK" cycle. It will be understood that upon completion of the "COOK" cycle arm 88 is thereafter cycled by rotation of the sub-interval cam 80. Thus, cam track 74 must have a diameter sufficiently small to permit the follower 102 to drop without contacting the cam track to thereby enable the striker 98 to contact bell 100.

The present invention thus provides a novel control of an electrical appliance and particularly a microwave cooking oven, in a manner permitting the appliance to be pulsed for short duration "ON" time upon completion of the normal "COOK" mode of operation. The present invention permits the appliance to continue intermittent "KEEP WARM" mode of operation upon the conclusion of normal duty cycle. An audible warning that such intermittent operations is, in process is provided until such time as the operator manually advances the programmer cam drum to shut the power off to the appliance and programmer timer.

Although the invention has herein above been described in the presently preferred practice, it will be understood by those having skill in the art that the invention is capable of modification and variation and is limited only by the following claims.

I claim:

1. A control system for an electrical cooking appliance comprising:

(a) means operable upon connection to a source of electrical power to provide radiant energy for cooking;

(b) first switch means operable upon actuation and to make and upon de-actuation to break a circuit between said radiant energy provider and said source of power;

(c) programmer timer means having a single timing motor and operable upon electrical energization to provide a pre-selected cooking interval of actuation for said first switch means;

(d) second switch means operable upon actuation to made and upon de-actuation to break a connection between said timer motor and said source of power;

(e) third switch means electrically in parallel with said first switch means and operable upon actuation to complete and upon de-actuation to break a circuit between said radiant energy provider and said power source;

(f) said programmer timer means including first cam means operable to effect actuation of said first switch means for a pre-selected program interval and third cam means operable to actuate and de-actuate said third switch means at sub-intervals of said program interval and second cam means operable to effect actuation of said second switch means for a predetermined interval for maintaining said timer motor energized when said first and third switch means are de-actuated; and, (g) mode selector switch means operable upon user actuation to one position to enable energization of said radiant energy source through said second and third switch means and operable upon user actuation to another position to enable energization of said radiant energy source only through said first switch means;

(h) said programmer timer means includes dwell means operable to prevent actuation of said first switch means when said mode selector is in said one position and said second switch means is actuated.

2. The control system defined in claim 1, wherein said dwell means includes an oscillating advance pawl, a driving ratchet indexed by said pawl and a notch in said ratchet operative to prevent ratchet indexing upon contact of said notch by said pawl.

3. The control system defined in claim 1, wherein said sub-interval cam means is rotated by said motor and has a period of rotation equal to said sub-interval; and, said cam means operative to effect said actuation of said third switch means comprises a cam follower contacting said sub-interval cam means.

4. The control system defined in claim 1, further comprising alarm means operably responsive to and cycling of said sub-interval cam means.

5. The control system defined in claim 1, wherein said sub-interval cam means includes a lost-motion driving connection with said programmer timer means.

6. A control system for an electrical appliance comprising:

(a) first circuit means including switch means operable upon actuation to connect and upon deactuation to disconnect the appliance function load to a source of electrical power;

(b) timer means operable upon electrical energization to provide cyclic advance of a driving pawl;

(c) ratchet means operable to index upon said cyclic advance of said pawl;

(d) first cam track means operably indexed with said ratchet means;

(e) second cam track means operably indexed with said ratchet means;

(f) sub-interval cam means operably driven by said timer means to cycle with a period generally equal to said cyclic advance of said pawl;

(g) first circuit means including a second switch means operable upon actuation to electrically energize and your deactuation to de-energize said programmer timer means;

(h) second circuit means including third switch means electrically in parallel with said first switch means said third switch means operable upon actuation to connect and upon deactuation to disconnect said appliance function load to said power line through said second switch means said third switch means including cam follower means responsive to said sub-interval cam means for cycling said third switch means;

(i) said second switch means including cam follower means responsive to said second cam track to said first switch means including cam follower means responsive to said first cam track for cycling said appliance load function; and, (j) model selector switch means operable upon user actuation to one position to select said second circuit means for current flow to said timer means and operable upon user actuation to another position to by-pass said second circuit means and provide current to said timer means through said first circuit means;

(k) said ratchet means includes dwell means operable upon contact with said pawl to prevent said pawl advance from further indexing of said ratchet means until said ratchet means is actually advanced past said dwell means wherein said first cam track causes said first switch means to be de-actuated when said dwell means prevents said indexing and said sub-internal cam means cycles power to said load through said third switch means.

7. The control system defined in claim 6 wherein said sub-interval cam means is operative to actuate said third switch means for a minor portion of said sub-interval period.

8. The control system defined in claim 6 wherein said dwell means and said second cam track are arranged to maintain said second switch actuated during and beyond the interval of actuation of said first switch means such that said timer means continues to cycle said sub-interval cam means.

9. The control system defined in claim 6, further comprising alarm means operable in response to cycling of said sub-interval cam means.

10. The control system defined in claim 6, wherein said sub-interval cam means includes means effecting a lost-motion driving connection with said timer means.

* * * * *